US005450701A

United States Patent [19]

White

[11] Patent Number: 5,450,701

[45] Date of Patent: Sep. 19, 1995

[54] LATCHING SCREEN CORNER

[75] Inventor: John P. S. White, Smyrna, Tenn.

[73] Assignee: Caradon Better-Bilt, Inc., Smyrna, Tenn.

[21] Appl. No.: 92,837

[22] Filed: Jul. 19, 1993

[51] Int. Cl.[6] ..... E04C 2/38

[52] U.S. Cl. ..... 52/656.9; 52/475.1; 160/381

[58] Field of Search ..... 52/656.9, 475.1, 476; 403/295; 160/369, 371, 377, 381

[56] References Cited

U.S. PATENT DOCUMENTS

| | | | |
|---|---|---|---|
| 410,217 | 9/1889 | Stone | 160/381 |
| 1,238,854 | 9/1917 | Watson | 160/381 |
| 3,317,227 | 5/1967 | Nijluis | 52/656.9X |
| 3,782,054 | 1/1974 | Goss | 52/656.9 X |
| 4,296,587 | 10/1981 | Berdan | 52/656.9 X |
| 4,502,260 | 3/1985 | Machler | 52/656.9 |
| 4,506,478 | 3/1985 | Anderson | 49/181 |
| 4,683,634 | 8/1987 | Cole | 403/295 X |
| 4,691,486 | 9/1987 | Niekrasz | 403/295 X |
| 4,725,083 | 2/1988 | Schauer | 403/295 X |
| 5,076,162 | 12/1991 | Goin | 160/381 X |
| 5,076,736 | 12/1991 | Grewe | 403/295 |

FOREIGN PATENT DOCUMENTS

| | | | |
|---|---|---|---|
| 685067 | 8/1966 | Belgium | 52/656.9 |

*Primary Examiner*—Carl D. Friedman
*Assistant Examiner*—Beth A. Aubrey
*Attorney, Agent, or Firm*—Robert A. Seemann

[57] ABSTRACT

A bracket for a screen frame corner has a bolt for latching the frame in a window frame, and intersecting tracks for the bolt, one track in each leg, from which the bolt may be extended from the bracket. Bifurcated radial spring legs on the bolt grip the track. The bolt may be inserted in a track by a front opening in bracket, and a frame bar mounted on the leg prevents removal of the bolt from the track. The corner bracket and the bolt with spring are each, molded single elements.

9 Claims, 5 Drawing Sheets

LATCHING SCREEN CORNER

BACKGROUND OF THE INVENTION

1. Field of the Invention

This invention pertains to retaining a screen frame assembly in a window, more particularly to a corner bracket used in constructing a standard screen frame, in which the bracket is designed for retaining the screen frame assembly in a window by latching it in the window frame.

It is common in the manufacture of a window screen frame assembly, to insert two legs of a 90 degree angle corner bracket, into adjacent ends of hollow frame bars which comprise the four sides of the frame.

One example of the manufacture is described in U.S. Pat. No. 4,506,478, patented by Anderson, Mar. 26, 1985. The description may be found at column 14 line 43 through column 15, line 9, as it applies to FIGS. 29–34 of that patent.

In the present invention, the corner bracket has a pair of crossed tracks and a track-engaging, sliding, frame retainer latch bolt, and the window frame which is to receive the screen is adapted for receiving the front end of the latch bolt.

2. Description of the Prior Art

U.S. Pat. No. 410,217 patented Sep. 3, 1889 by D. Stone describes a screen frame having a corner-piece with a tubular opening in one of its arms. The tubular opening is provided with a bolt that is thrown out by a coiled spring behind the bolt within the tube. A stem projecting up through a slot in the corner-piece is topped off by a finger piece for drawing the bolt back into the tubular opening against the spring tension. The window frame molding includes sockets for receiving the front end of the bolt at various heights along the window frame.

U.S. Pat. No. 1,238,854 patented by W. Watson, Sep. 4, 1917, describes a screen frame corner-piece having a tubular barrel in one of its two legs. The tubular barrel is provided with a bolt that is thrown out by a coiled spring behind it, within the tube. The rear end of the bolt has a rod extension that passes through the center of the spring and extends through an opening in the tube behind the spring. The portion of the rod beyond the tube is pivotally attached to a finger lever that is pivotally attached to, and passes through, the frame rail in which the first leg is located. Pulling on the lever draws the bolt back into the barrel against the spring tension.

SUMMARY OF THE INVENTION

It is one object of the invention to provide a screen frame assembly corner bracket which has a frame retainer bolt.

It is another object of the invention to provide a screen frame corner bracket with retainer bolt in which the bolt may be installed in one of two possible directions within the bracket.

It is another object that the retainer bolt can be installed in the bracket in one of two possible directions in a track which the bolt body engages directly in either an extended or retracted position of the bolt with respect to the bracket.

It is yet another object that the bolt body engages the track with a bifurcated spring molded as one piece with the bolt.

It is still another object that the corner bracket with springly track engaging bolt, installable within the track in one of two directions consist of only two elements which can be shipped as separate items, and assembled in the bracket in the direction desired just before insertion of the bracket leg containing the bolt into the hollow frame bar, and that the bolt may not be removed after insertion of the leg into the hollow frame bar.

It is another object that the limit of extension of the bolt be controlled by the track, and the limit of withdrawal of the bolt back into the bracket be limited by the hollow frame bar.

Other objects and advantages of the invention will become apparent from the ensuing description of the invention.

The bracket of the present invention has first and second legs. Each leg has a track that is adapted for receiving a bolt, the front end of which can be extended from the bracket. The tracks intersect one another and each track traverses the bracket and terminates at an opening in a respective wall of the bracket.

The intersection of the tracks is spaced from the two termination walls.

The bolt has spring means adapted for bearing radially on the track which receives the bolt. Preferably, the spring means comprises bifurcated legs at the back of the bolt. A finger on one of the legs may be received in a detent on each of the tracks.

The corner bracket and legs with tracks are molded in a single element, and the bolt and spring means are also molded in a single element.

A first stop means on each of the tracks limits the forward travel of the bolt by direct engagement with the bolt.

A second stop means on each of the first and second legs limits forward travel of a frame bar on the leg by direct engagement with the leg.

Means on the bolt is adapted for limiting the rearward travel of the bolt by direct engagement with a frame bar engaging the second stop means on the leg receiving the bolt.

One of the tracks is open to the front side of the bracket sufficiently to receive the bolt through the front side. The frame bar prevents removal of the bolt by way of the front side opening when the frame bar is engaging the second stop means.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
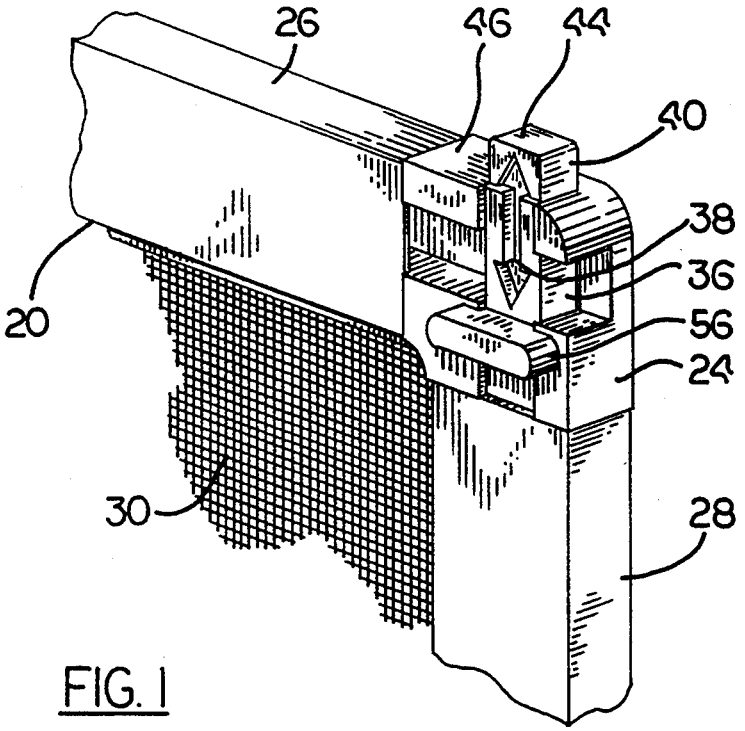
FIG. 1 is an elevated front view of a right front corner portion of a screen frame assembly, including screen, with a screen frame corner bracket according to the present invention, installed in adjacent hollow frame bars.

Before explaining the invention in detail, it is to be understood that the invention is not limited in its application to the detail of construction and arrangement of parts illustrated in the drawings, since the invention is capable of other embodiments and of being practiced or carried out in various ways. It is also to be understood that the phraseology or terminology employed is for the purpose of description only and not of limitation.

Referring to FIG. 1, screen frame assembly 20 includes corner bracket 24, top hollow frame bar 26, and right side hollow frame bar 28, and insect screen cloth 30. Frame retainer bolt 36 is shown with the front 40 of the bolt extended forward, beyond face 46 of outside corner 52 of corner bracket 24. The frame retainer bolt can be moved forward or back as indicated by double ended arrow 38 between the extended position shown, and a retracted position in which front face 44 is approximately coplanar with top face 46 of corner bracket 24.

Figure 2:
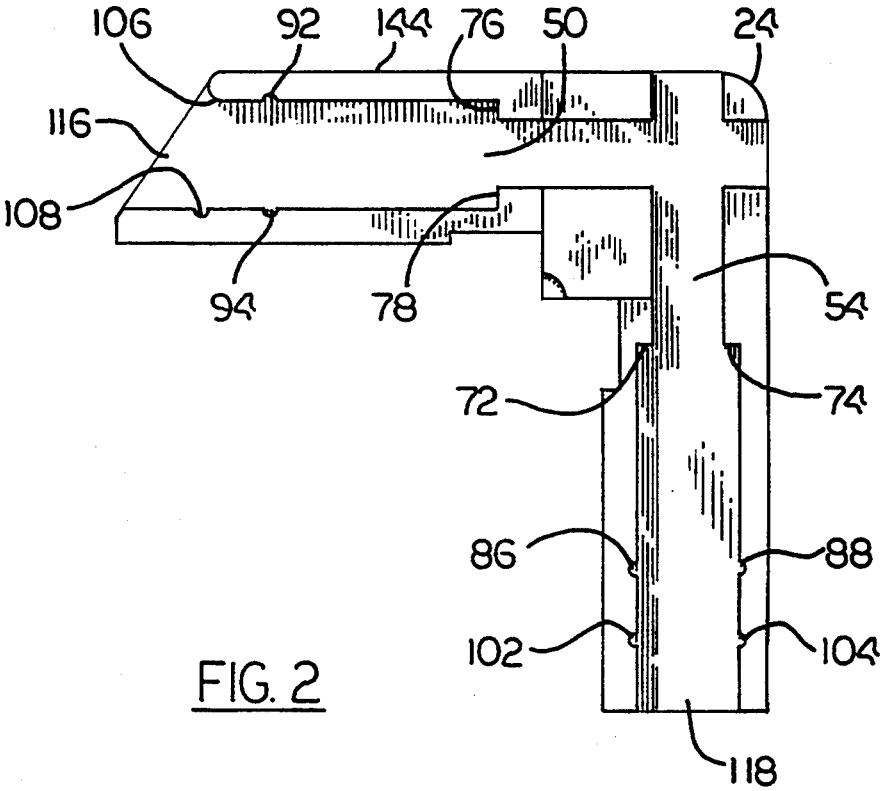
FIG. 2 is a front view of a screen frame corner bracket according to the invention.
Figure 3:
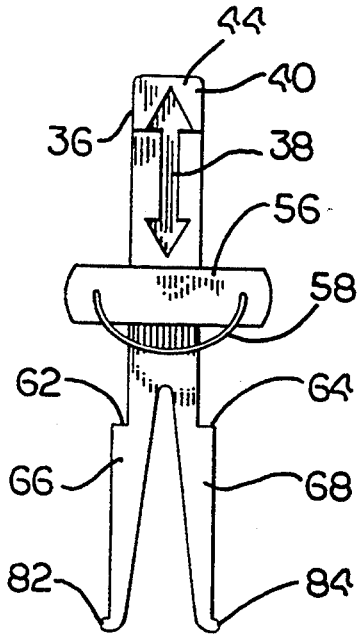
FIG. 3 is a front view of a track-engaging sliding latch body according to the invention.

Referring to FIGS. 2 and 3, screen frame corner bracket 24 shown in FIG. 2, has two tracks, track 50 and 54, crossing through one another at 90 degrees. When bracket 24 is located at the upper right hand corner of a screen frame as shown in FIG. 1, track 50 receives the frame retainer bolt shown in FIG. 3, in horizontal reciprocally sliding motion in which front face 44 of bolt 36 extends from the bracket beyond face 48 of outside corner 52, similarly to the above description with regard to face 46, or track 54 receives the bolt in vertical reciprocally sliding motion. The bolt may be gripped by cross-bar stop 56, or by finger ring 58 for drawing it forward or back in the track. Corner 52 comprising surfaces 46 and 48 preferably has a shape to fit the inside corner of the window in which the present invention system will be installed. Outside corner 52, therefore, will usually be a right angle corner as shown, but may be rounder or otherwise angled as desired.

Left and right forward stop shoulders 62 and 64 on bifurcated left and right legs 66 and 68 of frame retainer bolt 36 engage shoulders 72 and 74 of track 54, limiting the forward most travel of bolt 36 in track 54. In like manner shoulders 62 and 64 engage shoulders 76 and 78 on track 50 when the bolt is moving in track 50.

Divergent left and right fingers 82 and 84 on legs 66 and 68 bearing on the track generally normally to the length of the track engage left and right detents respectively 86 and 88 of track 54 to hold the bolt in the forward most position until it is drawn back by cross-bar stop 56 or finger ring 58.

In like manner, left and right detents 92 and 94 of track 50 hold the bolt in the forward most position when it is in track 50.

The bolt is held in the rearward most position in track 54 by engagement of fingers 82 and 84 in track 54 left and right detents 102 and 104.

In like manner, left and right detents 106 and 108 of track 50 hold the bolt in the rearward most position when it is in track 50. Detent 106 falls at the end of shortened wall 114, as the end of leg 116 is angled to ease insertion of the leg into a hollow frame bar.

Leg 118 is squared off at the end, but may also be angled if desired.

Figure 4:
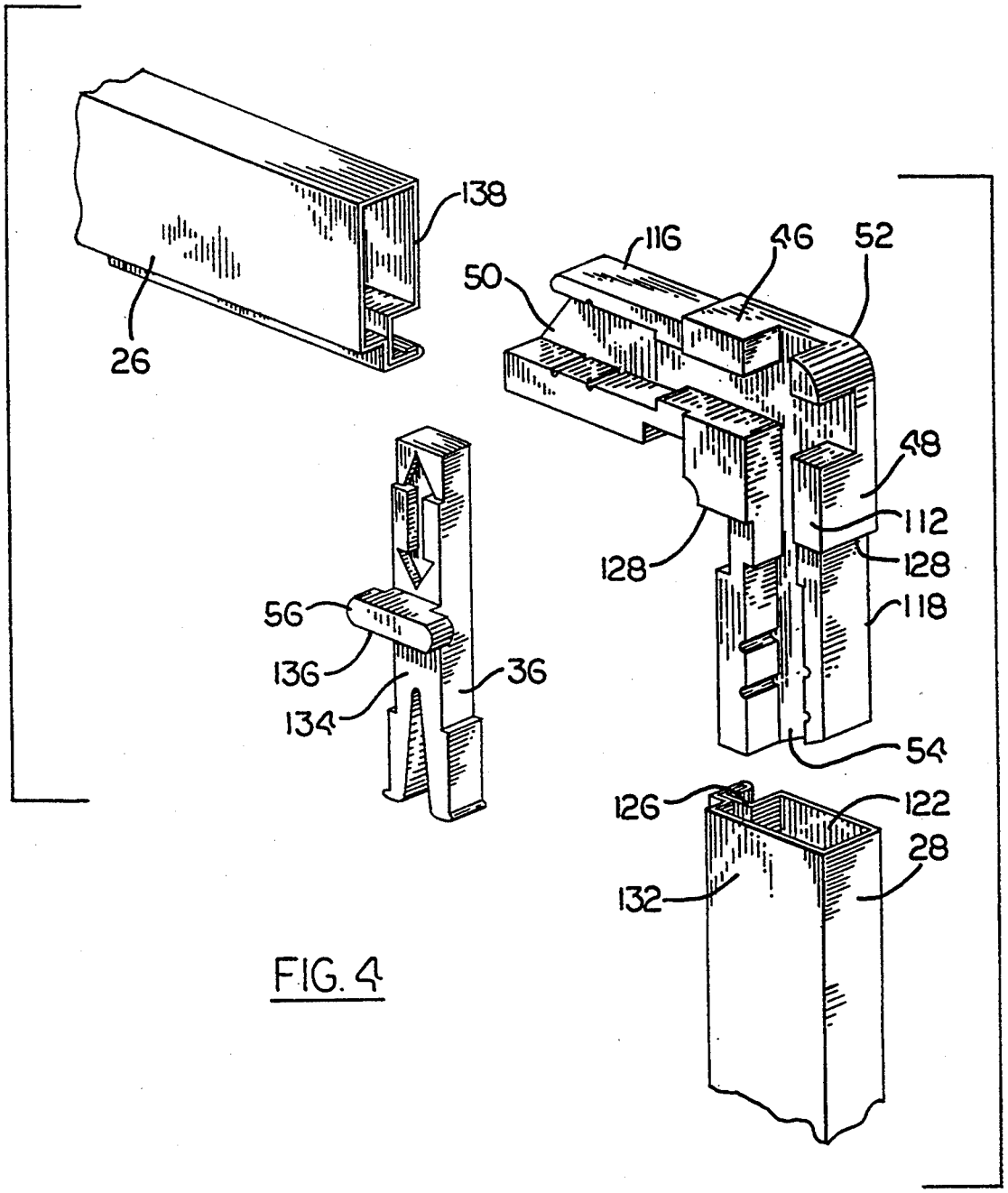
FIG. 4 is an exploded view of a screen frame assembly of two hollow frame bars, the corner bracket shown in FIG. 2, and the track-engaging, sliding latch bolt shown in FIG. 3.

Turning now to FIG. 4, assembly comprises the steps of sliding retainer bolt 36 into track 50 of leg 116 at the distal end of the track, or pressing it into the track at the front side 112 of the bracket. Similarly, it is slid or pressed in to track 54 of leg 118. In FIG. 4, the bolt is aligned for locating slidingly in track 54.

Once the bolt is in place in track 54, leg 118 is inserted into opening 122 of hollow frame bar 28 until the end 126 of right side hollow frame bar 28 comes to a stop at shoulder plane 128. The inner surface of front wall 132 of bar 28 covers front face 134 of bolt 36 behind cross-bar stop 56, preventing the bolt from leaving track 54.

When bolt 36 is drawn back, it is stopped at the rearmost position by engagement of rear face 136 of cross bar stop 56 with end 126 of hollow bar 28. In like manner, end 138 of hollow bar 26 limits the rear most movement of bolt 36 by engagement of face 136 when the bolt is in track 50.

Figure 5:
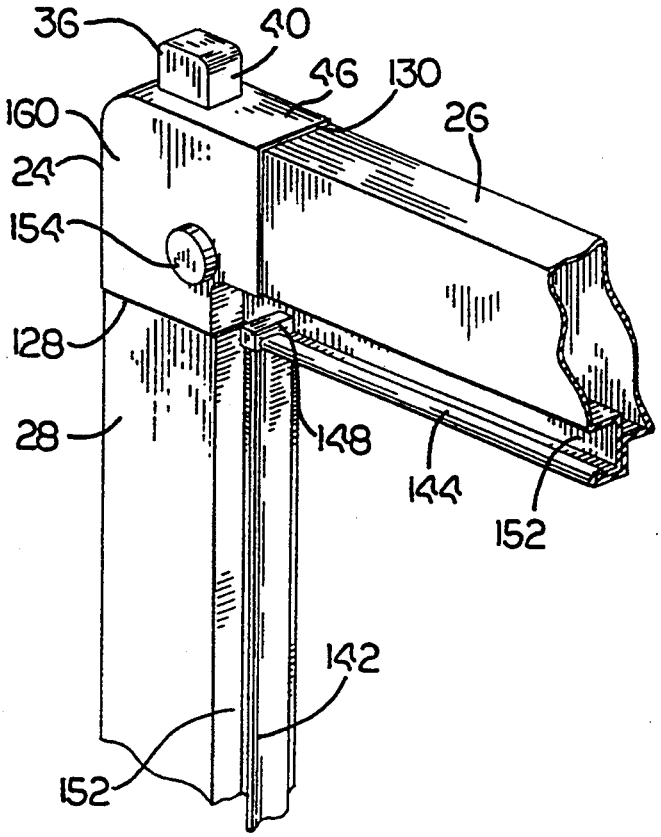
FIG. 5 is an elevated rear view of an assembled set of the hollow frame bars, corner bracket and sliding latch bolt shown in FIG. 4.

In the assembly as seen from the rear, in FIG. 5, front 40 of frame retainer bolt 36 is extended forward, beyond top face 46 of corner bracket 24. Right side hollow frame bar 28 and left side hollow frame bar 26 butt up fully respectively against shoulder planes 128 and 130 of legs 118 and 116 which are not shown in this figure.

Rolled seams 142 and 144, and pin 148 form continuous right angle channel 152 for a rubber bead strip that is usually used to hold insect screen cloth in a screen frame assembly. Position pin 154 on back side 160 of the bracket keeps the screen frame assembly from sliding about during installation or removal of the screen frame assembly from a window frame, as will be later described with respect to FIG. 7.

Figure 6:
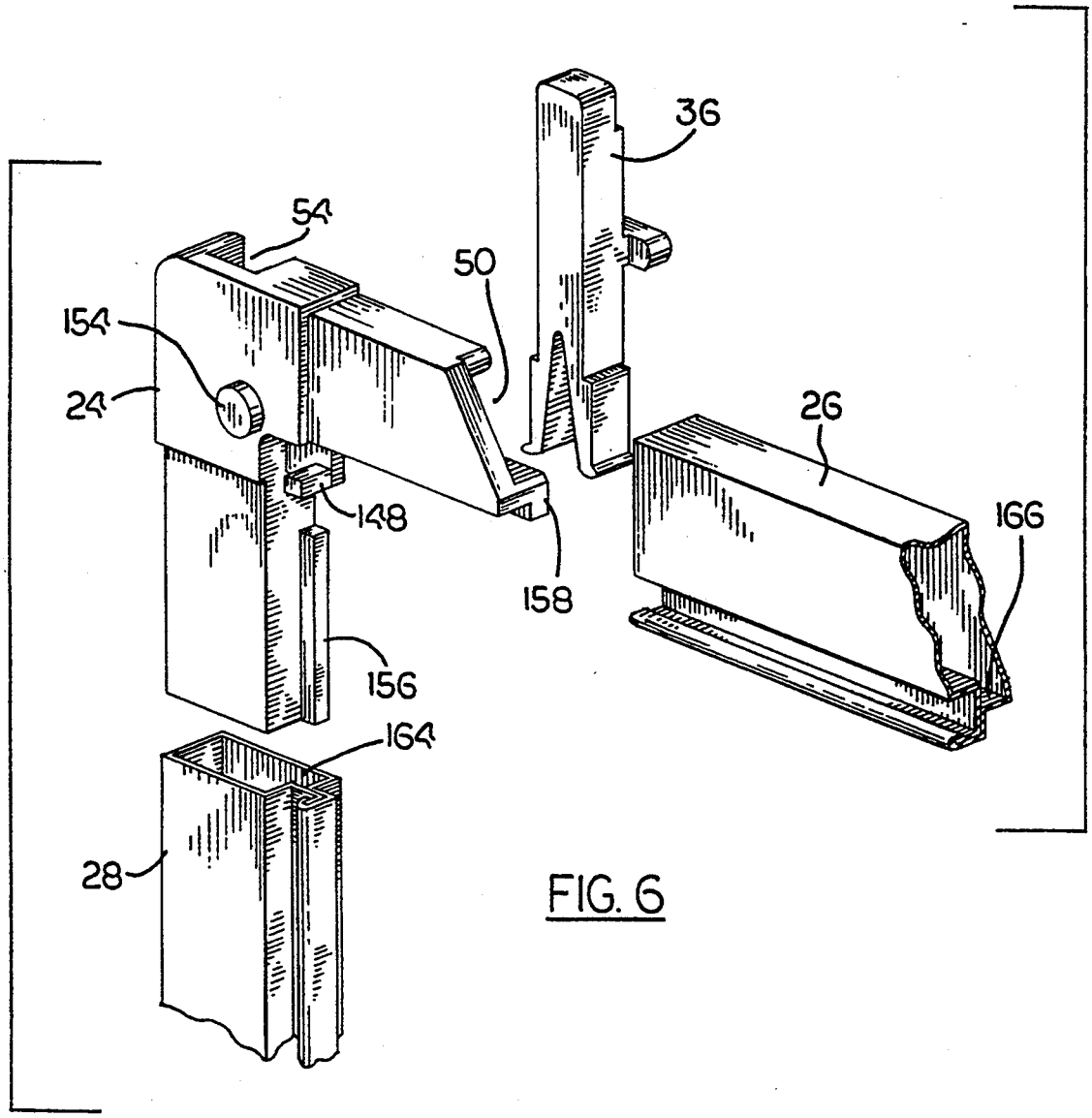
FIG. 6 is an exploded view of the assembly shown in FIG. 5.

Referring to FIG. 6, ridges 156 and 158 accommodate grooves 164 and 166 respectively.

Figure 7:
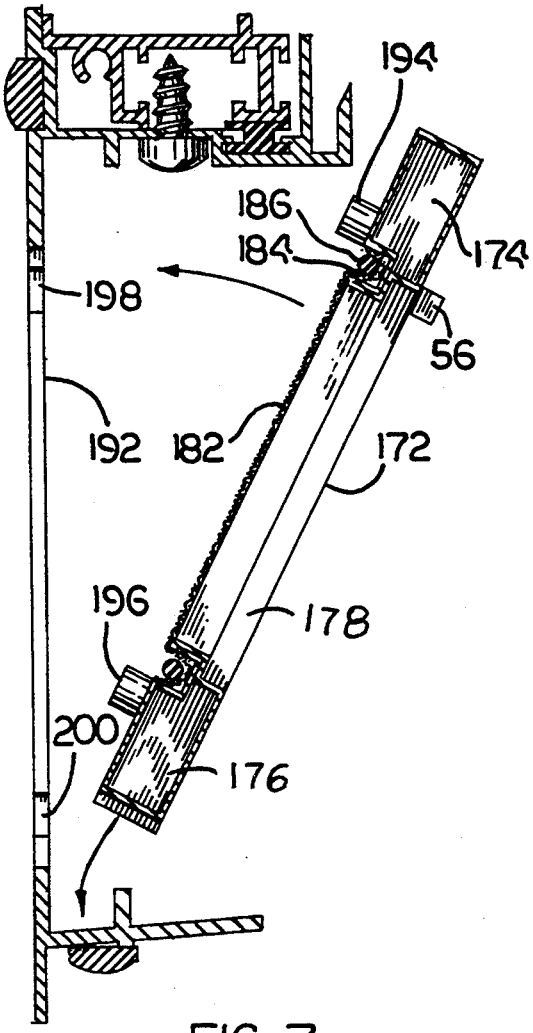
FIG. 7 is a side view in vertical cross section of a screen assembly having the present invention, being inserted in a window frame.

Screen assembly 172, FIG. 7, includes top and bottom hollow frame bars 174 and 176, right side frame bar 178, and insect screen cloth 182, held in surrounding channel 184 by rubber bead strip 186. The frame retainer bolt is drawn back by cross-bar stop 56, and is not in sight. The screen assembly is about to be installed in window frame 192. Upper and lower position pins 194 and 196 will closely fit into openings 198 and 200 respectively, preventing excessive movement of the screen assembly when urging force is applied by fingers to cross-bar stop 56.

Figure 8:
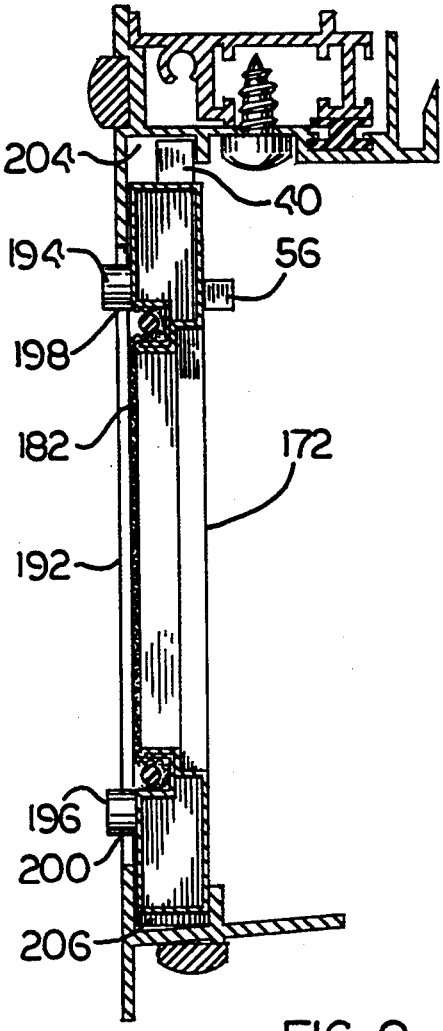
FIG. 8 is a side view in vertical cross section of the screen assembly of FIG. 7, with the bolt of the present invention retaining the screen frame assembly in a window frame.

In FIG. 8, screen assembly 172 is installed in window frame 192 with pins 194 and 196 received in openings 198 and 200. Cross-bar stop 56 has moved front 40 of frame retainer bolt 36 up into recess 204 to retain the top of screen assembly 172 in the frame. The lower part of screen assembly 172 being retained in the window frame by recess 206. In a screen assembly which has the present invention at the corners, one corner bracket and one frame retainer bolt may be assembled at any corner for bolt extension in one of two different directions, preferably 90 degrees apart.

As may be seen from the above drawings and description, the present invention provides for a screen frame corner assembly of as few as two elements, a latching screen corner comprising a universal corner bracket having a bolt that can be installed for extending in two different directions and which engages the track in which it moves with bifurcated spring legs molded as one with the bolt including track engaging fingers on the legs, and which is assembled integrally with the frame bars at any corner of the frame without change in design of the bracket or bolt bodies.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. An improved latching corner bracket for joining adjacent frame bars, said bracket having a front side, a back side, a first leg having a front end and a back end, a second leg having a front end and a back end, a first wall between said front and back sides connected to said front and back sides, a second wall between said front and back sides connected to said front and back sides and connected to said first wall and comprising with said first wall an outside corner between said front ends of said first and second legs, and including a bolt having a back end, and a front end which may be extended from said bracket, the improvement comprising:

a first track in said first leg, said first track being for receiving said bolt, said first track being generally straight and generally parallel to said first leg, and having a first end toward the back end of said first leg and traversing said bracket, said second end of said first track terminating at an opening in said first wall for extending the front end of said bolt from said bracket beyond said first wall, a second track in said second leg, said second track being for receiving said bolt, said second track being generally straight and generally parallel to said second leg, having a first end toward the back end of said second leg and traversing said bracket, said second end of said second track terminating at an opening in said second wall for extending the front end of said bolt from said bracket beyond said second wall, spring means on said bolt bearing on the track receiving said bolt generally normally to the length of the track, said spring means comprising bifurcated legs.

2. The improved latching corner bracket described in claim 1, further comprising:

said bifurcated legs being at the back end of said bolt, a finger on one of said bifurcated legs, and a detent on each of said first and second tracks for receiving said finger.

3. An improved latching corner bracket for joining adjacent frame bars, said bracket having a front side, a back side, a first leg having a front end and a back end, a second leg having a front end and a back end, a first wall between said front and back sides connected to said front and back sides, a second wall between said front and back sides connected to said front and back sides and connected to said first wall and comprising with said first wall an outside corner between said front ends of said first and second legs, and including a bolt having a back end, and a front end which may be extended from said bracket, the improvement comprising:

a first track in said first leg, said first track being for receiving said bolt, said first track being generally straight and generally parallel to said first leg, and having a first end toward the back end of said first leg and traversing said bracket, said second end of said first track terminating at an opening in said first wall for extending the front end of said bolt from said bracket beyond said first wall, a second track in said second leg, said second track being for receiving said bolt, said second track being generally straight and generally parallel to said second leg, having a first end toward the back end of said second leg and traversing said bracket, said second end of said second track terminating at an opening in said second wall for extending the front end of said bolt from said bracket beyond said second wall, stop means on each of said first and second tracks for limiting travel of said bolt in the direction of said extending of said front end of said bolt from said bracket by direct engagement with said bolt, stop means on each of said first and second legs for limiting travel of one of said frame bars on the leg toward the front end of the leg by direct engagement with said leg.

4. The improved latching corner bracket described in claim 3, further comprising:

said first track being open to the front side (112) of said bracket sufficiently to receive said bolt through the front side of said bracket, said frame bar preventing removal of said bolt by way of the front side of said bracket when said frame bar is engaging said the stop means on said first leg.

5. The improved latching corner bracket described in claim 4, further comprising:

a position pin on the back side of said bracket.

6. An improved latching corner bracket for joining adjacent frame bars, said bracket having a front side, a back side, a first leg having a front end and a back end, a second leg, a wall between said front and back sides connected to said front and back sides, and including a bolt having a back end, and a front end which may be extended from said bracket, the improvement comprising:

a track in said first leg, said track receiving said bolt, said track being generally straight and generally parallel to said first leg, and having a first end toward the back end of said first leg and traversing said bracket, said second end of said track terminating at an opening in said wall for extending the front end of said bolt from said bracket beyond said wall, and spring means on said bolt, bearing on the track, said spring means comprising bifurcated legs.

7. The improved latching corner bracket described in claim 6, further comprising:

said bifurcated legs being at the back end of said bolt, a finger on one of said bifurcated legs, and a detent on said track for receiving said finger.

8. An improved latching corner bracket for joining adjacent frame bars, said bracket having a front side, a back side, a first leg having a front end and a back end, a second leg, a wall between said front and a sides connected to said front and back sides, and including a bolt having a back end, and a front end which may be extended from said bracket, the improvement comprising:

a track in said first leg, said track receiving said bolt, said track being generally straight and generally parallel to said first leg and having a first end toward the back end of said first leg and traversing said bracket, said second end of said track terminating at an opening in said wall for extending the front end of said bolt from said bracket beyond said wall, spring means on said bolt, bearing on the track, a first stop means on said track for limiting travel of said bolt in the direction of said extending of said front end of said bolt from said bracket, by direct engagement with said bolt, a second stop means on said first leg for limiting travel of one of said frame bars on the first leg toward the front end of the first leg by direct engagement with the first leg, and means on said bolt, limiting travel of said bolt toward the back end of said first leg by direct engagement with the frame bar on said first leg.

9. An improved latching corner bracket for joining adjacent frame bars, said bracket having a front side, a back side, a first leg having a front end and a back end, a second leg having a front end and a back end, a first wall between said front and back sides connected to said front and back sides, a second wall between said front and back sides connected to said front and back sides and connected to said first wall and comprising with said first wall an outside corner between said front ends of said first and second legs, and including a bolt having a back end, and a front end which may be extended from said bracket, the improvement comprising:

a first track in said first leg, said first track being for receiving said bolt, said first track being generally straight and generally parallel to said first leg, and having a first end toward the back end of said first leg and traversing said bracket, said second end of said first track terminating at an opening in said first wall for extending the front end of said bolt from said bracket beyond said first wall, a second track in said second leg, said second track being for receiving said bolt, said second track being generally straight and generally parallel to said second leg, having a first end toward the back end of said second leg and traversing said bracket, said second end of said second track terminating at an opening in said second wall for extending the front end of said bolt from said bracket beyond said second wall, said first and second tracks intersecting one another, spring means on said bolt bearing on the track receiving said bolt, stop means on each of said first and second tracks for limiting travel of said bolt in the direction of said extending of said front end of said bolt from said bracket by direct engagement with said bolt, stop means on each of said first and second legs for limiting travel of one of said frame bars on the leg toward the front end of the leg by direct engagement with said leg, and means on said bolt limiting travel of said bolt by direct engagement with the frame bar on the leg.

* * * * *

UNITED STATES PATENT AND TRADEMARK OFFICE

CERTIFICATE OF CORRECTION

PATENT NO. : 5,450,701

DATED : September 19, 1995

INVENTOR(S) : John P. S. White

It is certified that error appears in the above-identified patent and that said Letters Patent is hereby corrected as shown below:

In Claim 8, column 6, line 61, delete "a" after "a wall between said front and", and replace therewith, --back--.

Signed and Sealed this

Second Day of January, 1996

*Attest:*

Bruce Lehman

BRUCE LEHMAN

*Attesting Officer*

*Commissioner of Patents and Trademarks*